United States Patent [19]

Zecman

[11] Patent Number: 5,012,856

[45] Date of Patent: May 7, 1991

[54] FLUID COOLED SHOT SLEEVE

[76] Inventor: Kenneth P. Zecman, 46520 Strathmore, Plymouth, Mich. 48170

[21] Appl. No.: 487,385

[22] Filed: Mar. 2, 1990

Related U.S. Application Data

[63] Continuation-in-part of Ser. No. 279,924, Dec. 5, 1988, Pat. No. 4,926,926.

[51] Int. Cl.[5] ..... B22D 17/00

[52] U.S. Cl. ..... 164/312; 164/113

[58] Field of Search ..... 164/113, 312–318

[56] References Cited

U.S. PATENT DOCUMENTS

| | | | |
|---|---|---|---|
| 2,244,816 | 6/1941 | Von Lynn | 164/314 |
| 3,015,849 | 1/1962 | Mittelstadt et al. | 164/314 |
| 3,515,203 | 6/1970 | Parlanti et al. | 164/312 |
| 3,533,464 | 10/1970 | Parlanti et al. | 164/312 |
| 3,664,411 | 5/1972 | Carver et al. | 164/312 |
| 3,672,440 | 6/1972 | Miura et al. | 164/314 |
| 3,685,572 | 8/1972 | Carver et al. | 164/312 |

FOREIGN PATENT DOCUMENTS

| | | | |
|---|---|---|---|
| 144256 | 7/1986 | Japan | 164/113 |
| 475543 | 11/1937 | United Kingdom | 164/314 |

*Primary Examiner*—Richard K. Seidel
*Assistant Examiner*—Edward A. Brown
*Attorney, Agent, or Firm*—Krass & Young

[57] ABSTRACT

A fluid cooled shot sleeve assembly for transferring molten metals. The shot sleeve is of a three layer construction in which a copper intermediate layer is attached to the outside surface of an inner metal charging chamber. A high strength outer jacket is fitted onto the copper intermediate layer and serves to hold the inner metal charging chamber straight until excessive heat buildup in the charging chamber is dissipated by the copper layer. A heat transfer conduit of semi-circular design is located within the wall of the metal charging chamber and in contact with the intermediate copper insert. This conduit permits a heat transfer fluid such as water to cool both the inner steel charging chamber which is in contact with the molten metal and lower the temperature of the copper layer to increase its ability to transfer heat from the metal charging chamber.

20 Claims, 1 Drawing Sheet

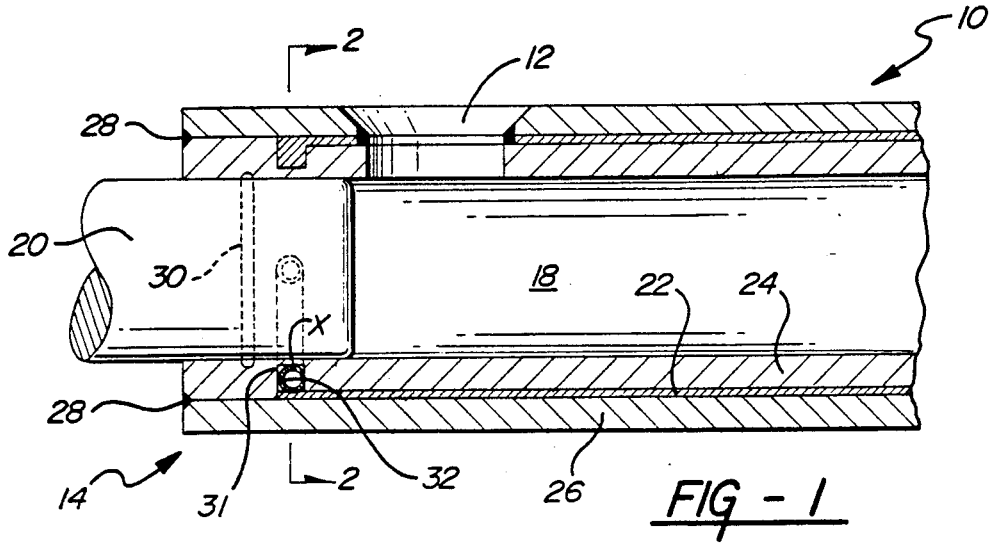
FIG - 1
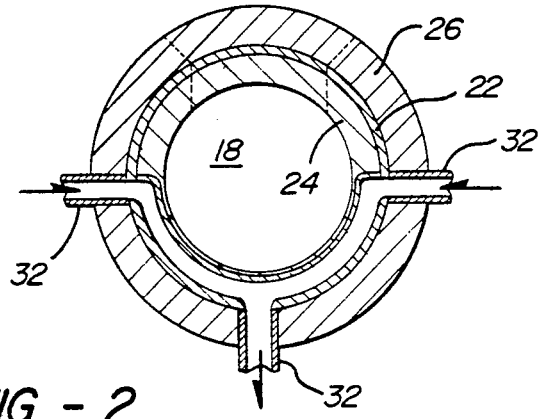
FIG - 2
FIG - 4
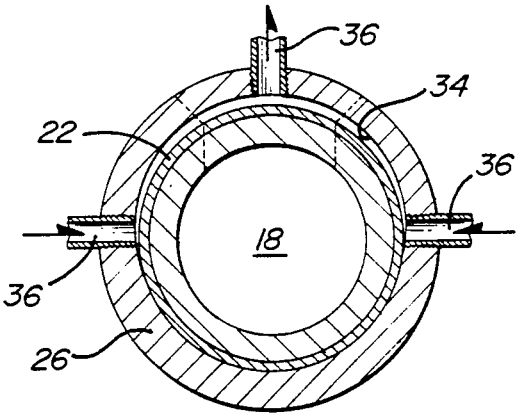
FIG - 3
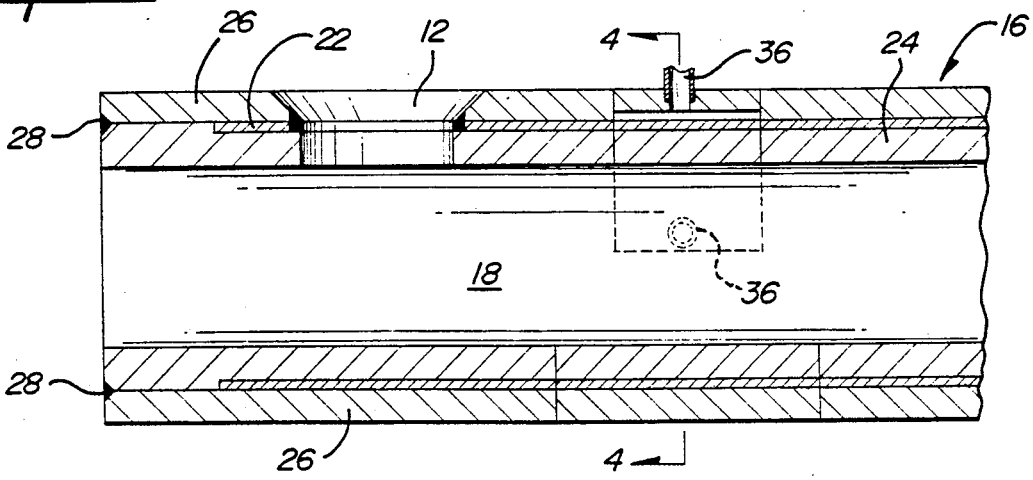

FLUID COOLED SHOT SLEEVE

REFERENCE TO RELATED APPLICATIONS

This application is a continuation-in-part of U.S. patent application Ser. No. 279,924, filed Dec. 5, 1988, now U.S. Pat. No. 4,926,926, entitled Three Layer Shot Sleeve.

FIELD OF THE INVENTION

The present invention relates to an apparatus for molding molten metals and, more particularly, to an improved, shot sleeve assembly having a construction which is unique in providing high heat transfer from the metal charge chamber so as to minimize temperature distortion problems within the shot sleeve.

BACKGROUND OF THE INVENTION

A shot sleeve is a device for injecting molten metal into a die or mold. Relatively simple in construction, it typically comprises a metal cylinder defining an axial chamber and a piston fitted within the chamber to act as an injection ram. An aperture in the side of the sleeve opens into a portion of the cylinder chamber just in front of the piston when it is in the rest position. This portion of the chamber is called the "well" and the molten metal is poured into the well for temporary residence before the piston is actuated.

Because of the high temperature difference between the molten casting metal and the elements of the shot sleeve, useful life expectancy of prior art devices is quite short. This is believed to be due in part to warpage and erosion of the axial chamber, and resulting piston wear. The surface of the bore opposite the well is subjected to the highest temperature. By the time molten metal has entered the rest of the bore, it has cooled and is much less damaging. The temperature differential from the top to the bottom in a horizontal sleeve creates warpage in the sleeve.

This problem of warpage and erosion is exacerbated when the shot sleeve is used at higher casting rates or with metals having a high melting point. Thus, while aluminum has a lower melting point than, for example, steel or iron, aluminum has a much higher rate of heat transfer (approximately five times as high as steel or iron). Moreover, the cycle for casting aluminum is much shorter than that for steel or iron and, consequently, many more pounds of aluminum may be cast per hour than is the case of other metals. Hence, many more BTU's are transferred per hour to the shot sleeve than is generally encountered in casting of ferrous metals. For example, while iron or steel is generally cast at a temperature of approximately 3000° F., the quantities are small, one or two pounds, and the interval between shots is much longer (as much as 5 to 10 times) compared to aluminum where cycle times allowing as little as 30 seconds between shots is not uncommon.

Since the casting cycle is shorter and the heat transfer rate is higher, conducting the damaging heat away from the pour hole area must be done in a much shorter time, and thus, efficient heat transfer is very important.

Efforts have been made to increase the useful life of a shot sleeve by a variety of methods, such as water or air cooling the sleeve itself. In U.S. Pat. No. 3,533,464 to Parlanti, a plurality of radially extending, heat dissipating fins are disposed about the periphery of the injection chamber of the shot sleeve. U.S. Pat. No. 3,515,203 to Parlanti et al., discloses a laminated injection cylinder particularly useful for die casting high temperature molten metals, such as iron or steel. An inner sleeve formed of a super alloy is surrounded by an intermediate layer of beryllium copper alloy, which is in turn enclosed by an outer shell comprised of heat treated H-13 steel. The intermediate beryllium copper layer extends all the way to the die end of the shot sleeve chamber. This laminated shot sleeve relies solely on heat transfer from the inner layer to the outer layer by the intermediate layer to prevent excessive heat build-up in the well area of the shot sleeve.

U.S. Pat. No. 3,672,440 to Miura et al. discloses an injection cylinder useful in the die casting of ferrous and other metals of high melting points. The injection cylinder, which is inclined with respect to the horizontal, comprises an outer cylindrical sleeve of high heat conductivity and an inner cylindrical lining which is removably fitted in the outer sleeve. The inner lining includes a plurality of cylindrical sections of short axial length which are clamped together. If any of the sections become warped or otherwise damaged during molding operations, the damaged section may be removed and replaced.

While the systems disclosed by Parlanti et al. and Miura et al, may be useful for casting metals having high melting points, neither system is totally satisfactory for use in casting metals having low melting temperatures, such as aluminum or magnesium. The beryllium copper layer in the Parlanti et al. device extends all the way to the die end of the shot sleeve, this end of the sleeve is held in place by the die. The end of the sleeve fitted into the die expands as heat is absorbed by the steel sleeve. Typically, an aluminum biscuit, which cushions the impact of the piston as the piston packs the molten metal into the die, forms at the die end of the sleeve. Hence, during rapid cycling, the two ends of the shot sleeve are heated at a much faster rate than the middle of the sleeve. The sleeve at the die end of Parlanti et al.'s sleeve would expand much more than the middle, causing the fit between the piston and the sleeve to change drastically.

Similarly, the short cycle time and high heat transfer typical of aluminum casting negates the usefulness of Muira's shot sleeve when applied to low melting point metal with high heat transfer capability, such as aluminum or magnesium casting. Since the beryllium copper sections comprising the inner liner are removable, they necessarily cannot be fitted tightly within the outer shell. The rate of transfer of heat from the hot inner sleeve to the outer shell is, necessarily, compromised.

In my U.S. Pat. No. 4,623,015 I disclose an improved shot sleeve for molding molten metals which has a surface pattern of copper welded to the outside of the metal body of the shot sleeve. The spiral pattern of the welded copper is designed to passively convey heat away from the well area.

While the device disclosed in my above-cited U.S. patent has found some commercial acceptance, it has certain limitations. Since the copper is disposed on the outside surface of the shot sleeve, it is relatively far away from the hot metal and heat transfer is, thus, impaired. Certain shot sleeves which are components with standard die casting machines have sleeve walls of a relatively great thickness, thus exacerbating the problem.

Another major advance in shot sleeve construction is disclosed in my U.S. Pat. No. 4,926,926. There, a unique shot sleeve construction is presented which is based on a three-layer body wall construction which has the ability to rapidly dissipate a great amount of heat from the central chamber or inner barrel of the shot sleeve. As noted above, such temperature control is needed to prevent warpage which can interfere with movement of the plunger or piston within the shot sleeve central bore to the point where the shot sleeve cannot charge the die to which it is coupled.

While the shot sleeve construction of U.S. Pat. No. 4,926,926 has proven highly successful, the die casting art continues to move in the direction of faster cycling, which in turn presents increased problems of thermal strain and wear. Accordingly, I have continued to experiment with thermal control within the shot sleeve charging bore, and have now discovered a cooling arrangement which provides even more rapid heat transfer from the metal charging bore.

SUMMARY OF THE INVENTION

This invention relates to fluid cooling of the shot sleeve disclosed in U.S. Pat. No. 4,926,926. I have now discovered a cooling arrangement which is particularly effective in removing large amounts of heat from the shot sleeve inner barrel while, at the same time controlling the heat transfer so as to avoid heat checking or cracking of the steel wall. This type of heat checking or cracking is typical of thermal fatigue or shock; the shock of depositing hot metal into too cold a sleeve.

In U.S. Pat. No. 4,926,926, there is disclosed and claimed a shot sleeve assembly having a novel three-layer construction designed for moving molten metal into a mold cavity. The shot sleeve assembly includes an elongated shot sleeve which has a bore extending axially therethrough from a first, or shot, end to a second, or die, end adapted to be positioned adjacent to the mold cavity. A well opening extends through a side wall of the sleeve at a location adjacent the first end. An injection piston is slidably mounted in said bore for reciprocal motion therein.

The three-layer shot sleeve includes an inner barrel extending the length therein which is, preferably, comprised of X-100 steel alloy which has a higher than average heat transfer rate for steel. Welded, brazed or otherwise fused onto the outer diameter of the barrel is an intermediate layer formed of commercially pure copper. Unlike the inner barrel, this layer does not extend the full length of the shot sleeve. It commences at a point between or medial the shot end and the well and terminates at a point proximate and spaced from the second, or die, end of the shot sleeve. An outer shell formed of heat treated alloy steel having a high yield strength is shrink fit onto the two-layer assembly formed by the inner barrel and outer layer. Unlike the inner barrel, the outer shell extends only to the collar or approximately 60% to 75% the length of the barrel. The mass of the outer shell is substantially greater than that of the inner barrel. The yield strength of the outer shell is also substantially greater than that of the inner barrel due to heat treatment.

Shrink fitting the outer shell onto the inner barrel and outer layer assembly confers several advantages. The copper layer is compressed by the outer shell and is, thus, held in tight contact therewith, thereby improving heat transfer rate as well as affording a heat sink or place to dump the excess heat. The outer shell, which is held under tension and has a greater mass and yield strength than the inner barrel, serves also to hold the inner barrel rigid and prevent the shot sleeve assembly from warping excessively. This effect is heightened by the fact that the copper layer does not extend to both ends of the shot sleeve assembly. The two steel layers contact each other at both ends and are welded together. This increases the rigidity of the shot sleeve assembly and prevents deformation during repeated cycling.

Despite the greatly improved heat control characteristics of my three-layer shot sleeve described above, I observed that when the casting rate of a metal such as aluminum is increased to more than approximately 400 pounds per hour, a further increase in heat transfer from the charging chamber is desirable. Initially, I attempted to provide such increased heat transfer by bringing a cooling fluid into contact with the shot sleeve. Unfortunately, conventional water cooling techniques, such as spraying the outer surface of the shot sleeve with water or flowing water through passages provided adjacent the sleeve bore almost always resulted in cracking of the sleeve. The cracking is believed to result form the severe temperature gradient created between the inside wall of the sleeve bore which is in direct contact with molten metal to be charged (in the case of aluminum this is a temperature of about 1250° F.) and the portion of the sleeve in contact with the cooling fluid.

In an attempt to avoid such cooling fluid induced cracking the present state of the art generally teaches drilling several passages in the body of the shot sleeve in a direction parallel to the shot sleeve chamber or bore. A tube is then inserted on each of the passages and a cooling fluid such as water is passed through the tube and back out of the passage on the outside of the tube. Unfortunately, this technique is not particularly successful in preventing stress cracking in steel sleeves. This is true because steel cannot transfer the heat through the wall of the sleeve fast enough to keep up with the rate at which water takes the heat away. Consequently, a heat gradient builds until the steel cracks because of the drastic temperature differential.

My present invention is a unique shot sleeve which has special application for metal charging operations wherein superior heat transfer and distribution is required in order to avoid warpage and heat erosion of the shot sleeve axial chamber. The shot sleeve of the invention employs the three-layer construction disclosed in U.S. Pat. No. 4,926,926 and further includes a fluid cooling of the high heat transfer intermediate layer of the sleeve. The manner in which this cooling is achieved is critical however, and unlike the prior art, I discovered it is desirable to avoid direct cooling of the hottest portion of the shot sleeve, which is the area immediately adjacent the sleeve pour hole. Instead, cooling is applied to the intermediate layer at an area slightly removed from the sleeve pour hole area. In essence, cooling is applied to the lower temperature areas of the shot sleeve as opposed to the highest temperature portions.

BRIEF DESCRIPTION OF THE DRAWING

The following detailed description may best be understood by reference to the following drawing in which:

FIG. 1 is a partial longitudinal section view of a shot sleeve apparatus constructed according to the present invention;

FIG. 2 is a section view taken on line 2—2 of FIG. 1;

FIG. 3 is a partial longitudinal section of a second embodiment of the invention; and FIG. 4 is a cross section view taken on line 4—4 of FIG. 3.

DETAILED DESCRIPTION OF THE PREFERRED EMBODIMENTS

In the following detailed description, like reference numerals are used to refer to the same element of the invention shown in multiple figures thereof.

Referring now to the drawing, and in particular to FIG. 1, the shot sleeve of the present invention includes a hollow, substantially cylindrical body 10 having a side opening well 12 mediate a first, or shot end 14 and a second, or die end 16 fabricated to fit a casting machine platen (not shown). Sleeve 10 is bored through to form a central bore; i.e., an axial extending chamber 18 which receives a piston 20. Well 12 is adjacent the face of the piston 20 in its rest position. After molten metal is poured into the well 12, the piston 20 is actuated by suitable means to displace the molten metal longitudinally through the chamber or bore 18 and into a casting die (not shown) in a conventional fashion.

In actual practice, molten metal is poured from a ladle into well 12. The well opening may be circular or oval.

The temperature of the molten metal should be sufficiently high above the freezing point thereof as to minimize the chance of premature freezing due to the die casting operation. On the other hand, the temperature of molten metal in the ladle should not be excessively high; otherwise, unnecessary contraction will occur during the liquid cooling and resultant solidification process. For example, in the case of molten aluminum, the temperature of the melt varies between 1200 degrees and 1350 degrees F. depending on the specific alloy being cast and other parameters such as shot weight and cycle time.

Having been introduced into the shot sleeve 10 from well 12, the molten metal will then radiantly, convectively, and conductively dissipate a high amount of thermal energy. Unless such dissipation occurs in a controlled manner, frequent and expensive replacement of the piston 20 is necessary. Down time in repairing the shot sleeve piston is expensive since capital equipment and manpower stands idle.

In accordance with the invention described in my U.S. patent referred to above, excessive heat can be removed from the well 12 by means of a unique shot sleeve construction wherein a copper intermediate layer 22 is welded to an inner barrel 24. As may be seen in FIG. 1, copper layer 22 does not extend the full length of the shot sleeve 10 but, rather, commences at a point between or mediate the shot end 14 and the well 12 and terminates at a point spaced inwardly from the end of the shot sleeve which engages the casing machine. The intermediate copper layer 22 extends some length less than the total length of the shot sleeve (generally 30% to 60% of the total length), and is always located directly beneath the well 12. The copper layer 22 may, however, extend forward from a location rear of the well 12 towards but short of the die end 16. Outer shell 26, which is held under tension, encloses both inner barrel 24 and copper intermediate layer 22. Outer shell 26 is attached to the inner barrel 24 at both ends of the shot sleeve 10 by means of welds 28. Outer shell 26 extends approximately 60% to 75% of the length of shot sleeve 10, but in some cases can extend to the die end of the shot sleeve. A lubrication groove 30 is also preferably provided in the central bore wall 18.

Preferably, the inner barrel 24, the inner wall of which defines the central chamber or bore 18, is fabricated from a steel having good heat transfer capabilities such as PCX or X-100 steel, which has approximately 15% better heat conductivity than material such as H-13 or higher alloy tool steels. This allows quicker heat transfer to the copper intermediate layer 22.

Preferably, the inside diameter of the outer shell 26 is several thousandths of an inch smaller than the outside diameter of the inner barrel 24. After the copper outer layer 22 is welded to the inner barrel 24, the outer shell 26 is first heated until it expands sufficiently to fit over the welded unit. The outer shell 26 is then fitted over inner barrel 24 and copper layer 34. As outer shell 26 cools, it shrinks onto inner barrel 24 leaving the inner barrel in compression.

Copper has an expansion rate that is approximately 50% greater than that of steel. It also transfers heat at a rate almost ten times faster than steel. Shrink fitting of outer shell 26 onto inner barrel 24 traps copper layer 22 in a limited area between the two steel layers 24,26. As inner barrel 24 is heated with molten metal during the casting process, it transfers its heat first to copper layer 22. Due to copper's much higher rate of heat transfer, the heat transfer to copper layer 22 will first travel throughout the entire copper layer 22 before it is subsequently transferred to outer shell 26. This heat exchange helps ensure that outer shell 26 will be heated much more uniformly than inner barrel 24. By providing outer shell 26 more massive and of greater strength than inner barrel 24, outer shell 26 serves as a sort of straitjacket to minimize warping of the shot sleeve.

Copper layer 22 is contained at both its ends by the steel-to-steel welded construction. During cycling, unevenly heated inner barrel 24 will warp while outer shell 26 stays straight. If copper layer 22 were not contained at both ends as by welds 28, the warping of inner barrel 24 would squeeze the malleable copper out from between the two steel layers 24,26.

By acting as a mechanical straitjacket, the outer shell 26 holds unevenly heated barrel 24 rigid for several seconds. While shot sleeve 10 does still warp, this warpage occurs only after the molten metal has been delivered into the die with the piston 20. Because there are several seconds between injection cycles, copper layer 22 has time to transfer the heat more evenly, thus allowing the shot sleeve 10 to come back to a straight position. The ambient heat held in the mass of shot sleeve 10 is now distributed therethroughout, from top to bottom and from end to end.

As discussed above, despite the excellent heat transfer ability of the shot sleeve described above, there are applications involving very rapid metal charging cycles where even greater cooling rates for the shot sleeve are desirable. Conventional cooling techniques are not successful, however, due to localized chilling and thermal cracking of the shot sleeve in those areas where a fluid coolant is brought into contact with the hot shot sleeve. Likewise, if the sleeve is cooled too drastically, too much heat can be removed from the molten metal resulting in the premature formation of metal deposits.

The present invention is based on a unique cooling system for circulating a heat transfer fluid in the shot sleeve. In distinction to the prior art, the heat transfer fluid in the shot sleeve of this invention is kept away from the hottest part of the shot sleeve which is the area of the charge well. In a preferred embodiment, a fluid passageway or coolant conduit is provided wherein the passageway engages the intermediate copper layer 22 but is spaced from the wall portion of the inner barrel 24 closest the central bore of the shot sleeve. This can best be seen with particular reference to FIG. 1, which illustrates a groove 31 milled in the inner diameter wall of the inner barrel 24. Within the groove 31, a copper tube 32 is positioned such that there is a gap X between the outer wall of the copper tube 32 and the wall portion of the groove closest the shot sleeve central bore or axial chamber 18. The provision of a gap X, which has been found sufficient if on the order of twenty thousands of an inch (0.020) when copper tubing of ⅛ to ⅜ inch is used, prevents spot chilling and metal deposition within the central bore portion of the sleeve.

As cooling is provided to the cooler areas of the shot sleeve for the purpose of withdrawing heat from the intermediate copper layer, I have found that a sufficient cooling rate is achieved when the fluid passageway runs normal, i.e. of right angle to the longitudinal axis of the shot sleeve bore. As illustrated in FIG. 2, it may be desirable to use two heat transfer fluid inlets to one outlet in order to maintain a sufficient volume of fluid in contact with the copper intermediate layer. With reference to FIG. 1, the copper tubing 32 is preferably in contact with the intermediate copper layer 22, for efficient heat transfer and good results have been achieved by welding the copper tubing to the copper layer.

FIGS. 3 and 4 of the drawing illustrate a further embodiment of the invention wherein a shot sleeve is provided with a cooling system located between the well 12 and sleeve end portion 16 which is adapted to couple with a casting machine. This cooling system comprises an eccentric groove 34 machined in the inner wall of the outer shell 26. Fluid inlet ports 36 are drilled through the side of the shot sleeve and tapped so that threaded fittings may be screwed to the sleeve for connecting the sleeve to a heat transfer fluid source. Again, good results have been obtained through the use of two inlet ports spaced 180° from each other and one outlet port spaced 90° between the inlet ports. With aluminum metal casting rates of 1000 pounds per hour, good results were achieved with an eccentric groove of about two inches in width and about a maximum of 0.15 inch in depth. Again, in contrast to prior art disclosures, the groove is spaced up and away from the shot sleeve well area, which is generally the hottest portion of the shot sleeve. This avoids stress cracking and metal chilling problems.

In summary, to avoid warpage and erosion of the axial chamber of a shot sleeve, I have invented a heat transfer system which permits an economical heat transfer fluid such as water to be used without danger of shot sleeve cracking. For metal charging rates of less than about 1000 pounds per hour, a copper tube is positioned within a groove formed in the inner wall of the barrel of the shot sleeve. The tubing and overlying copper layer are welded to promote good heat transfer contact, but the copper tube is spaced from the wall portion of the groove closest to the shot sleeve bore to avoid spot chilling. The fluid transfer passageway should be spaced from the shot sleeve well to avoid severe stress on the shot sleeve which might result in cracking.

At non-ferrous metal charging rates in excess of 1000 pounds per hour, an additional cooling channel is employed wherein the heat transfer fluid is circulated between the copper intermediate and steel outer wall layers of the shot sleeve. As seen in the reference to FIG. 4, the heat transfer fluid is in direct contact with both the intermediate and outer walls and good results have been achieved in providing a channel by forming an eccentric groove on the inside diameter face of the steel outer wall.

While the herein invention has been described with reference to certain embodiments and exemplifications thereof, it is contemplated that other designs and arrangements of the herein claimed elements may become obvious to one skilled in the art without departing from the scope of the present invention which is defined by the claims appended hereto.

What is claimed is:

1. A shot sleeve assembly for moving molten metal into a mold cavity, said assembly having:

an elongated shot sleeve having a bore extending axially therethrough from a first end to a second end adapted to be positioned adjacent the mold cavity;

a well opening extending through a side wall of said shot sleeve at a location adjacent said first end;

an injection piston slidably mounted in said bore, said shot sleeve comprising:

an inner barrel having an inner and outer perimeter defining a wall extending the length of said shot sleeve;

a heat transfer sleeve having a higher thermal conductivity than said inner barrel disposed around the outer perimeter of the barrel to form a two-layer assembly;

a high strength outer shell enclosing under compression said two-layer assembly; and first cooling means disposed in contact with both the inner barrel and heat transfer sleeve portions of said body to promote heat transfer from the inner barrel.

2. A shot sleeve assembly according to claim 1 wherein said first cooling means is spaced axially from said well opening.

3. A shot sleeve assembly according to claim 1 wherein said first cooling means comprises a fluid conduit at least partially located in the wall of the inner barrel.

4. A shot sleeve assembly according to claim 1 wherein said first cooling means comprises a fluid conduit positioned within a groove formed in the outer perimeter of the inner barrel, and wherein said heat transfer sleeve overlies said groove and contacts said fluid conduit.

5. A shot sleeve assembly according to claim 4 wherein said fluid conduit is spaced radially outward from the portion of said groove which is closest to said inner perimeter.

6. A shot sleeve assembly according to claim 4 wherein said fluid conduit is positioned generally normal to a longitudinal axis of the shot sleeve, said fluid conduit extending about half of the circumference of the shot sleeve.

7. A shot sleeve assembly according to claim 4 wherein said groove and fluid conduit are located generally intermediate said well opening and first end of said shot sleeve.

8. A shot sleeve assembly according to claim 1 and further including second cooling means comprising a fluid passageway extending between said heat transfer sleeve and the high strength outer shell.

9. A shot sleeve according to claim 8 wherein said first and second cooling means are on opposite sides of the shot sleeve well opening.

10. The shot sleeve according to claim 9 wherein each of said first and second cooling means comprise passageways each extending generally normal to a longitudinal axis of the shot sleeve, said passageways each being of a length sufficient to extend at least around half of the circumference of the shot sleeve.

11. A shot sleeve assembly for moving molten metal into a mold cavity, said assembly having:

an elongated shot sleeve having a bore extending axially therethrough from a first end to a second end adapted to be positioned adjacent the mold cavity;

a well opening extending through a side wall of said shot sleeve at a location adjacent said first end;

an injection piston slidably mounted in said bore;

said shot sleeve comprising:

an inner barrel having an inner and outer perimeter defining a wall extending the length of said shot sleeve;

a heat transfer sleeve having a higher thermal conductivity than such inner barrel disposed around the outer perimeter of the barrel to form a two-layer assembly;

a high strength outer shell enclosing under compression said two-layer assembly; and first cooling means disposed in contact with both the inner barrel and heat transfer sleeve portions of said shot sleeve to promote heat transfer from the inner barrel; said first cooling means comprising a fluid conduit positioned in a groove formed in the outer perimeter of the inner barrel, said groove being located generally intermediate the shot sleeve well opening and said first end with the groove extending generally normal to a longitudinal axis of the shot sleeve.

12. A shot sleeve according to claim 11 wherein the fluid conduit extends at least about 180° around the circumference of the shot sleeve.

13. A shot sleeve according to claim 11 wherein said heat transfer sleeve overlies said groove and contacts said fluid conduit, said fluid conduit being spaced radially outward from the portion of said groove which is closest to the inner perimeter.

14. A shot sleeve according to claim 11 wherein said fluid conduit is fabricated of copper and contains a passageway through which water can be circulated as the heat transfer fluid.

15. A shot sleeve according to claim 14 wherein said heat transfer sleeve is formed of copper, and the inner barrel and outer shell are fabricated from steel alloy.

16. A shot sleeve according to claim 11 and further including second cooling means positioned on the opposite side of said well opening from the first cooling means and comprising a fluid passageway extending between said heat transfer sleeve and the high strength outer shell.

17. A shot sleeve assembly for moving molten metal into a mold cavity said assembly having:

an elongated shot sleeve having a bore extending axially therethrough from a first end to a second end adapted to be positioned adjacent the mold cavity;

a well opening extending through a side wall of said sleeve at a location adjacent said first end; and an injection piston slidably mounted in said bore, said elongated shot sleeve comprising:

an inner barrel having an inner and outer perimeter defining a wall extending the length of said shot sleeve;

an intermediate layer of high thermal conductivity material disposed around and secured to the outer perimeter of the inner barrel commencing at a point medial of the first end and the well and terminating at a point proximate and spaced from the second end to form a two-layer assembly; and a high yield strength outer shell enclosing under compression said two-layer assembly and extending beyond the terminal ends of said two-layer assembly, said outer shell being secured to the inner barrel to envelop and trap said intermediate layer, said outer shell having a mass and a yield strength substantially greater than that of said inner barrel;

said shot sleeve assembly further including first cooling means comprising a fluid conduit positioned within said wall of said inner barrel such that the fluid conduit is generally normal to the axially extending bore of the shot sleeve assembly, said fluid conduit being in engagement with the intermediate layer.

18. A shot sleeve according to claim 17 wherein said first cooling means is spaced from said shot sleeve well opening.

19. A shot sleeve according to claim 18 and further including second cooling means comprising a passageway located on an opposite side of the well opening from the first cooling means, said passageway extending between said intermediate layer and said outer shell.

20. A shot sleeve according to claim 19 wherein the second cooling means is generally normal to the axially extending bore of the shot sleeve.

* * * * *

UNITED STATES PATENT AND TRADEMARK OFFICE

CERTIFICATE OF CORRECTION

PATENT NO. : 5,012,856

DATED : May 7, 1991

INVENTOR(S) : Kenneth P. Zecman

It is certified that error appears in the above-identified patent and that said Letters Patent is hereby corrected as shown below:

On the title page under references cited, please add the following:

4,334,575 6/1982 Miki et al .....164/113

4,635,851 1/1987 Zecman .....239/133

4,667,795 5/1987 Zecman .....164/312

Signed and Sealed this

Twenty-second Day of September, 1992

*Attest:*

DOUGLAS B. COMER

*Attesting Officer*

*Acting Commissioner of Patents and Trademarks*